US005274938A

United States Patent [19]

McDonald et al.

[11] Patent Number: 5,274,938

[45] Date of Patent: Jan. 4, 1994

[54] CEILING MOUNTED DISPLAY UNITS

[75] Inventors: Wayne C. McDonald, Norcross; Albert F. Van Druff, Jr., Lawrenceville; J. Don Sircy, Norcross, all of Ga.

[73] Assignee: Cornerstone Products, Inc., Norcross, Ga.

[21] Appl. No.: 849,619

[22] Filed: Mar. 10, 1992

[51] Int. Cl.[5] ..... G09E 7/22

[52] U.S. Cl. ..... 40/617

[58] Field of Search ..... 40/617; 52/38, 39

[56] References Cited

U.S. PATENT DOCUMENTS

| | | | |
|---|---|---|---|
| 2,871,598 | 2/1959 | Pawelka | 40/617 X |
| 2,928,197 | 3/1960 | Zuckerman | 40/617 X |
| 3,309,805 | 3/1967 | Thomas | 40/617 |
| 4,564,165 | 1/1986 | Grant et al. | 52/39 X |
| 5,044,103 | 9/1991 | Izenberg | 40/617 |

OTHER PUBLICATIONS

*Visual Merchandising* advertisement, p. 65, Mar. 1975 "What's Your Hang-Up?".

*Primary Examiner*—Kenneth J. Dorner
*Assistant Examiner*—J. Bonifanti
*Attorney, Agent, or Firm*—N. J. Aquilino

[57] ABSTRACT

A display unit suspended adjacent to and backlit by a ceiling mounted light fixture, including a plurality of display material panels, each with a peripheral mounting flange. The display unit is mounted with a plurality of slotted openings on the panels which permit attachment of the mounting flange with a suitable mounting member using spring clips.

2 Claims, 2 Drawing Sheets

FIG. 1
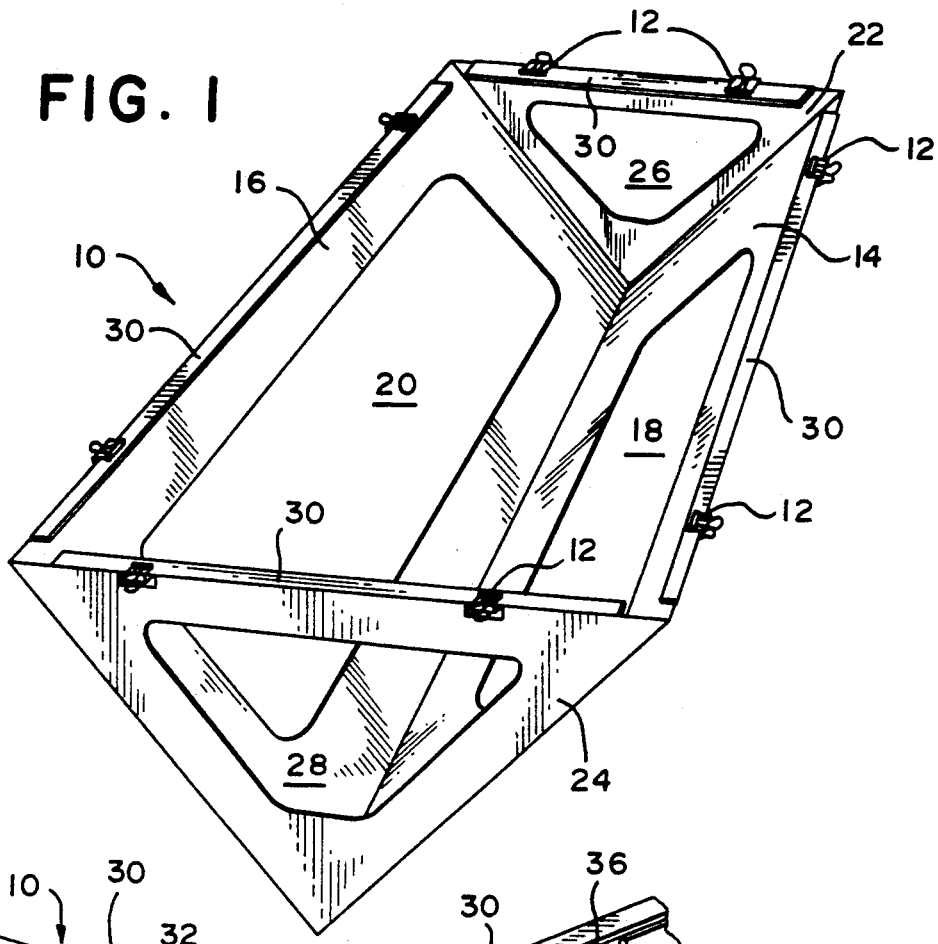
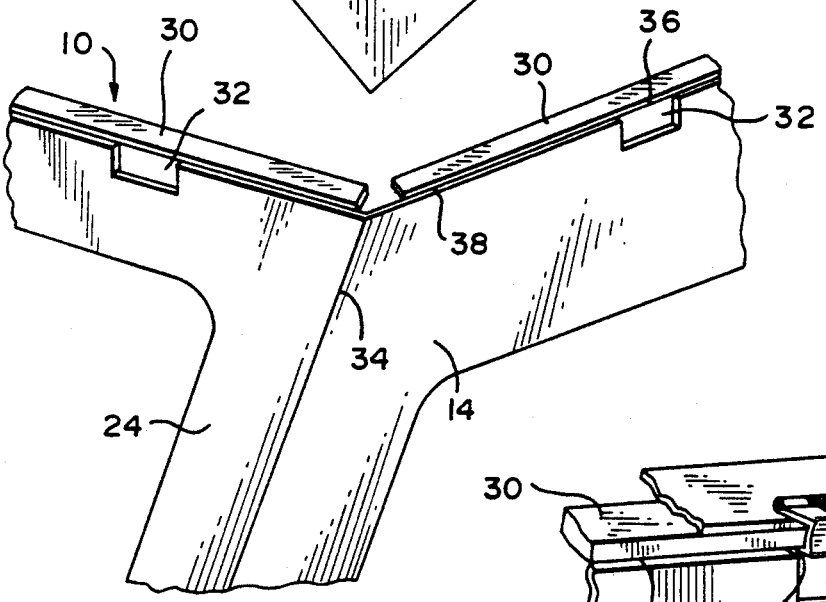
FIG. 5
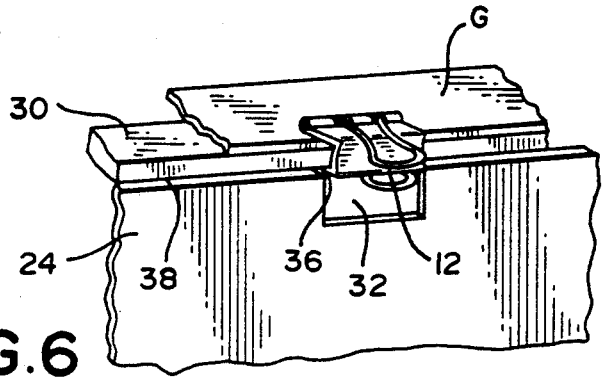
FIG.6

FIG. 4
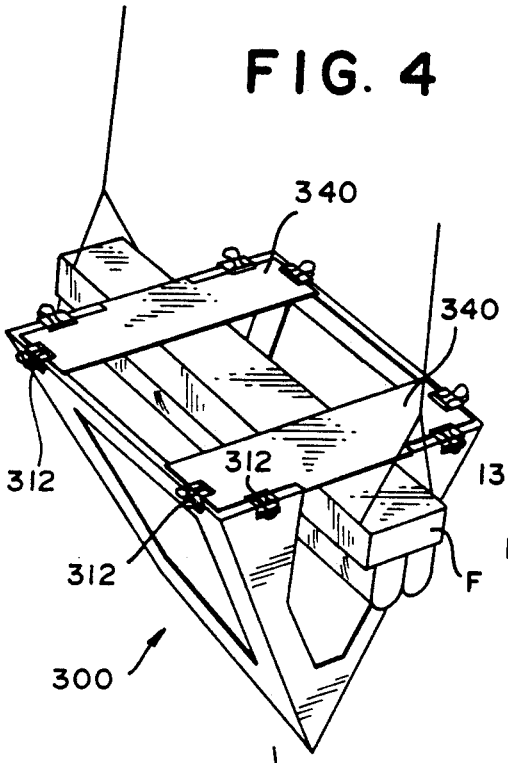
FIG. 2
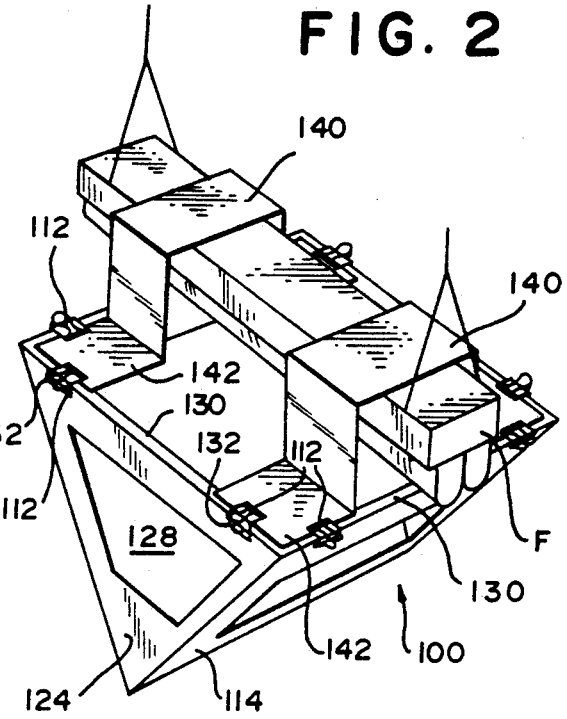
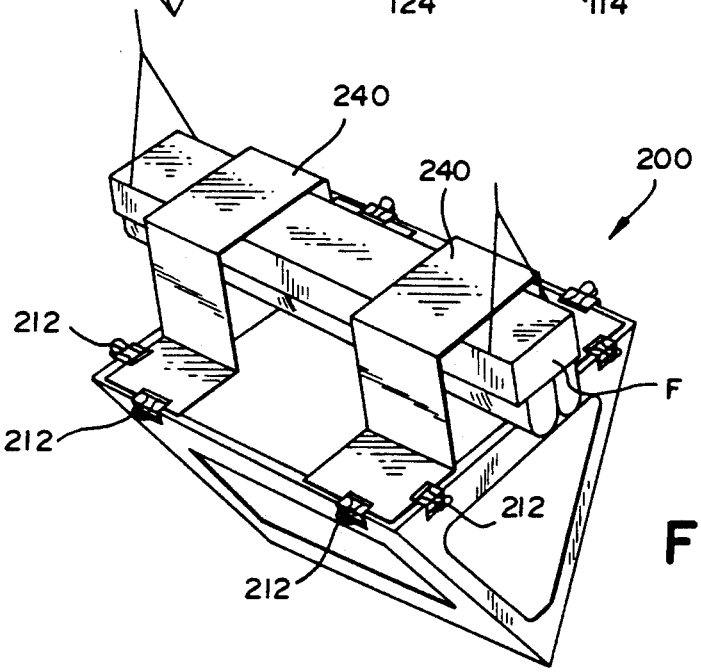
FIG. 3

CEILING MOUNTED DISPLAY UNITS

BACKGROUND OF THE INVENTION

The present invention relates to advertising and display signs and more particularly to such signs suspended from overhead lighting fixtures.

In many retail establishments, such as food stores, department stores, variety stores, shopping malls and the like, point-of-sale advertising is common. This advertising usually takes the form of a variety of display signs containing visual advertising media located at or adjacent a particular sales area. However, often the lack of space limits the amount of advertising which may be used in a particular location. In an effort to overcome this shortcoming, advertising and display material is hung from the ceiling or light fixtures in an attempt to gain a customer's attention.

Examples of the known prior art are shown in the U.S. Pat. Nos. to Lindsey (156,203), Shurette (4,075,775) Bellkin (4,136,474), Drueck, Jr. (4,290,218), Cobb (4,528,764) and Gross (4,716,671). All of these patents show various embodiments of illuminated overhead signs or advertising displays which are suspended from or mounted adjacent to overhead lighting units which backlight the display material. For example, the patents to Lindsey and Bellkin show display units which are hung from the lighting fixture. The patent to Gross is an advertising cover to fit directly over a fluorescent lighting fixture. The patents to Cobb, Drueck, Jr. and Shurette are display modules which are connected directly to the gridwork of a suspended ceiling adjacent a lighting fixture.

The present invention represents an improved lighting fixture display, which can be attached directly to the suspended ceiling grid adjacent a ceiling mounted lighting fixture or suspended from a fluorescent light tube fixture using an improved mounting system. In the preferred embodiments, the sign is formed of a geometric display portion, including display panels structured to support transparent or translucent display material in a position adjacent the light source in order to backlight the display for viewing purposes. In one preferred embodiment, the display module is triangular in cross-section, and is formed of a pair of side display windows and a pair of end display windows. The upper portion of the display unit includes a peripheral mounting flange which includes at least two slotted openings along each longitudinal side for the purpose of locating and receiving spring-mounted clips which attach the unit directly to the ceiling mounted grid or to a suitable mounting member. The display unit may also include one or two slotted openings along the end edges of the mounting flange which also accommodate mounting spring clips.

Other embodiments of the invention use mounts which are hung over a suspended light fixture which permit the display unit to be either mounted with its longitudinal axis parallel or perpendicular to the longitudinal axis of the fixture. Still another embodiment permits the mounting of the display unit to a flush mounted fluorescent ceiling fixture.

Among the objects of the present invention are the provision of an advertising and/or display unit which is easily hung from an overhead light fixture to provide improved visibility in a commercial sales environment. Another object is the provision of an advertising or display unit which is easily attached or removed from an overhead lighting fixture without requiring permanent installation. Still another object is the provision of an advertising and display unit which makes use of light provided by an overhead light fixture to backlight display material to provide increased visibility to customers without the necessity of an additional light source. Still another object is the provision of an advertising and display unit which may be interchangeably used within ceiling mounted lighting fixtures in a suspended ceiling grid system, or with a ceiling mounted fluorescent light system.

Other objects and advantages of the present invention will become apparent from the following description of preferred embodiments taken in conjunction with the accompanying drawings. The objectives and advantages of the invention will be realized and obtained by means of the elements, limitations and combinations particularly pointed out in the appended claims. The accompanying drawings, which are incorporated in and constitute a part of the specification, illustrate several embodiments of the invention, and together with the description, serve to explain the principles thereof.

DESCRIPTION OF THE DRAWINGS

FIG. 1 illustrates a perspective view of a display unit in accordance with the present invention.

FIG. 2 illustrates a display unit with an alternative mounting structure.

FIG. 3 illustrates an embodiment with a second alternative mounting structure.

FIG. 4 illustrates an embodiment of a display unit with a third alternative mounting structure.

FIG. 5 illustrates a detail of a display unit in accordance with the present invention.

FIG. 6 illustrates a detail of a display unit in accordance with the present invention with a mounting clamp attached to a ceiling grid.

DESCRIPTION OF THE PREFERRED EMBODIMENTS

FIG. 1 illustrates a first embodiment of an advertising or display unit 10 which is structured to be mounted directly underneath an in-ceiling overhead lighting fixture mounted on or onto the gridwork of the suspended ceiling. As will be described in detail hereinbelow, the unit 10 is designed to be mounted by a series of spring clips 12 directly to the suspended ceiling grid work. The display unit 10 is elongated and includes at least two display material panels 14 and 16 having windows 18 and 20 suitable for mounting transparent or translucent display material such as advertising or the like. The unit also includes two end panels 22 and 24 having windows 26 and 28, respectively, for mounting additional display material. The display unit is shown as being triangular in cross-section, but it will be appreciated that other geometrical cross-sectional shapes may be used in keeping within the spirit of the invention. The upper peripheral edge of the display unit 10 includes a longitudinal mounting flange 30 formed on each side and each end of the unit. Each flange 30 may be folded inwardly or outwardly with respect to the overall unit, depending upon the size and shape of the gridwork to which it is to be mounted.

Referring to FIG. 5, a detail of a display unit 10 is shown. An end panel and a side panel having windows formed therein are shown, with only the upper corners where these panels intersect, being shown for purposes of illustration. Longitudinal flanges 30 are shown folded inwardly. Each panel includes a pair of slotted openings 32, preferably rectangular in shape, spaced from each other and located adjacent the common fold line 34 at the end of each panel. As seen in FIGS. 5 and 6, an upper edge 36 of one of the openings 32 is coincident with a fold line 38, which forms an interface between the various display panels 14, 16, 22 and 24 and the mounting flange 30. Each opening 32 permits the insertion of a spring clip 12 which, when opened, is able to grasp the mounting flange 30 and suitable mounting structure, such as the metal gridwork G of a suspended ceiling for mounting the display unit. As shown, both a flat surface of the steel gridwork G and a planar upper surface of the mounting flange 30 are gripped by the clip 12 so that the clip securely holds the mounting flange 30 on the grid G, thereby keeping the display unit 10 in place. It will be appreciated that a single clip 12 is used at every opening so that the display unit is mounted on the gridwork along its peripheral edge at at least two points on each side and end thereof. Without the openings 32, it would not be possible for the clip 12 to grasp the flange 30 and the gridwork simultaneously.

FIG. 2 shows an alternate embodiment of a display unit 100 specifically designed to be mounted from a suspended lighting fixture F. The display unit is designed so that the longitudinal axis of the display unit 100 is perpendicular to the longitudinal axis of the lighting fixture. The display unit 100 is essentially the same type as described with respect to FIGS. 1, 5 and 6, and includes side panels 114 and end panels 124 having windows 128 therein as well as a mounting flange 130 across the upper periphery of the panels. A U-shaped mounting member 140 is designed to be placed over the lighting fixture, and includes a pair of wing members 142 which are attached to the mounting flanges 130 by using spring clips 112 inserted through suitable openings 132 positioned adjacent the intersection of the ends of the panels. As can be seen from the drawing, each wing member 142 includes two spring clips 112 which attach it to the flange 130 to ensure a strong and rigid connection to the display unit 100.

FIG. 3 illustrates a display unit 200 having an alternate mounting arrangement so that the longitudinal axis of the unit is mounted parallel to the longitudinal axis of a lighting fixture F. A pair of U-shaped mounting members 240 are attached with clips 212 in the same way as described with respect to FIG. 2 hereinabove, except they are positioned 90° from those shown in the prior figure. It will be appreciated that if the upper peripheral edges of the display unit are square, that same mounting members may be used no matter which direction the unit is oriented. If the display unit is rectangular in shape, the mounting members must be sized accordingly.

FIG. 4 shows still another arrangement of a display unit 300 being mounted on a lighting fixture F which is flush mounted to the ceiling. Normally, these types of fixtures are sufficiently spaced from the ceiling proper to permit the insertion of a planar mounting member 340 between the upper portion of the fixture and the ceiling. As can be seen, the planar mounting members are also attached by spring clips which cooperate with openings in the display panels to enable the clip to grip the mounting flange and the mounting member. As with the prior embodiments shown in FIGS. 2 and 3, the corners of each mounting member are provided with two clips to ensure stability and a rigid connection.

Whereas several embodiments of a suspended display unit are shown, it will be appreciated that other types, sizes and shapes of the display unit may be used as long as an upper peripheral mounting flange and corresponding openings for spring clips are incorporated in the mounting design. It will be appreciated that these other embodiments may be provided in keeping within the spirit and scope of the present invention, as defined in the following claims.

We claim:

1. The combination of a dropped ceiling having panels suspended from a support grid and a geometric shaped display unit mounted thereto comprising:

a plurality of display material panels formed on said display unit;

peripheral mounting flanges integrally attached to and folded along a fold line at upper edges of said display material panels;

a plurality of openings formed in said panels and located at said upper edges of said panels adjacent said mounting flanges, said openings having an edge coincident with said fold line between said mounting flanges and said display material panels; and, spring clip mounting means having spring biased jaws for mounting said display unit onto said ceiling support grid; said spring clip mounting means positioned within said opening, the jaws of said spring clip mounting means gripping and maintaining a planar surface of said mounting flanges in juxtaposition with a flat surface of said support grid for securing said display unit to said ceiling.

2. The combination of claim 1 wherein said openings are rectangular slots positioned adjacent a corner intersection of a pair of adjacent display panels.

* * * * *